United States Patent [19]

Weck

[11] Patent Number: 5,014,609

[45] Date of Patent: May 14, 1991

[54] INDUCTIVE AIR PASSAGE

[75] Inventor: Franz Weck, Herzogenrath, Fed. Rep. of Germany

[73] Assignee: H. Krantz GmbH & Co., Aachen, Fed. Rep. of Germany

[21] Appl. No.: 570,146

[22] Filed: Aug. 20, 1990

[30] Foreign Application Priority Data

Aug. 23, 1989 [DE] Fed. Rep. of Germany ..... 8910063

[51] Int. Cl.[5] ..... F24F 13/72

[52] U.S. Cl. ..... 98/40.14

[58] Field of Search ..... 98/40.01, 40.05, 40.1, 98/40.14, 40.18

[56] References Cited

U.S. PATENT DOCUMENTS 3,985,068 10/1976 Herb ..... 98/40.14

4,966,069 10/1990 Müller et al. ..... 98/40.18 X

FOREIGN PATENT DOCUMENTS 2650809 5/1977 Fed. Rep. of Germany ..... 98/40.01

*Primary Examiner*—Harold Joyce

*Attorney, Agent, or Firm*—W. G. Fasse

[57] ABSTRACT

An inductive air passage with a high fire resistance capability, that is easily paint coatable, and that can be economically produced, is made of die stamped sheet metal components. A slot-shaped inlet opening (1) is formed in a first sheet metal component and two outlet openings (2) are formed in a second sheet metal component. A baffle barrier (4) fits between the outlet openings (2). The two sheet metal components form plates (5, 6) and frames for the inlet opening (1) and for the outlet openings (2), respectively. One sheet metal plate (5) for the inlet opening (1) is provided with an I-shaped slit, whereby each of two curved lips (8) are produced by bending the lands formed by the I-slit toward one of the outlet openings (2). The other sheet-metal plate (6) has two U-shaped slits providing respective lands for forming tongues for defining the outlet openings (2). The tongues produced by the U-slits are angled toward the inlet opening (1) and toward the bent-over edges of the curved lips.

14 Claims, 3 Drawing Sheets

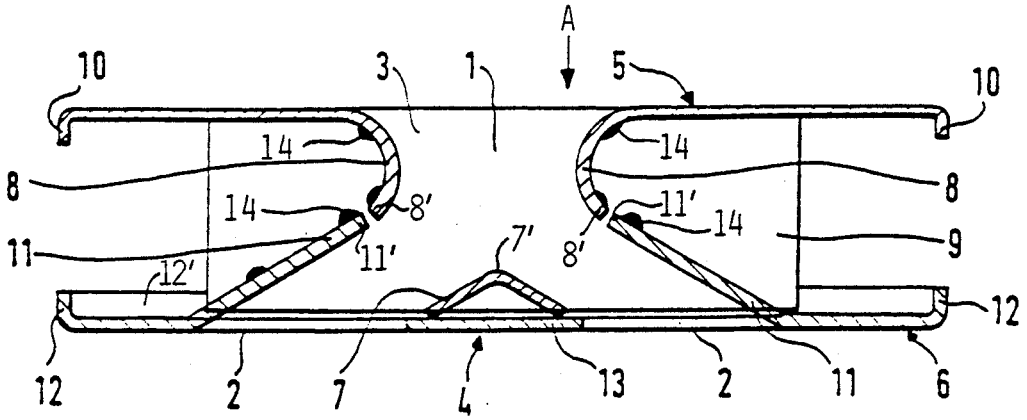
Fig. 1
Fig. 2
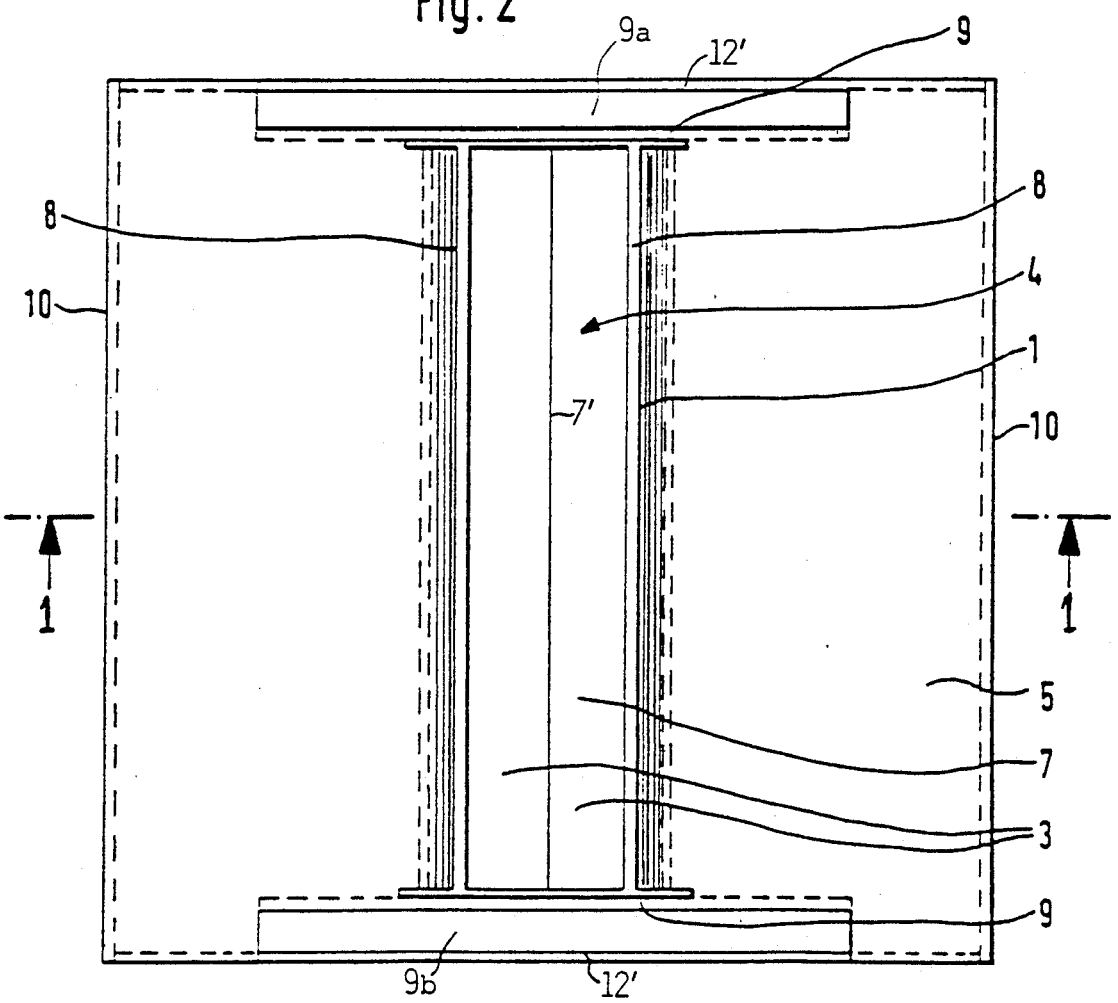

INDUCTIVE AIR PASSAGE

FIELD OF THE INVENTION

The invention relates to an inductive air passage or air outlet with at least one inlet opening and at least two outlet openings. These passages or outlets are used in ventilating and/or air conditioning an enclosed space.

BACKGROUND INFORMATION

Such inductive air passages are generally known and are preferably arranged in the ceiling area of a room that is to be ventilated and/or air conditioned. An inlet side of the passage is connected to conventional air channel systems. A baffle barrier is arranged lengthwise between two neighboring edges of two outlet openings. The projected surface area of the baffle barrier corresponds with the flow area cross-section of the inlet opening. The baffle barrier is arranged at a spacing perpendicularly to the plane of the inlet opening, as viewed in the flow direction. Due to the configuration of such air passages, the emerging air jets or streams have a high impulse and are therefore able to intensively mix with the air of the room before reaching a room area in which people are present, so that drafts are not noticeable in the room area where people are. The avoiding of drafts is important for health reasons, for example.

Inductive air passages of the above type are, as such, reliable in their mode of operation. However, known air passages of this type are usually made of plastics, preferably by injection molding, and are therefore, although they are relatively inexpensive, subject to two essential disadvantages. One disadvantage resides in the fact that the plastics used for making the known inductive air passages lack an adequate temperature stability, whereby the passages can even catch on fire, depending on the plastics used in the construction.

A second disadvantage is the fact that it is difficult to coat such plastic inductive air passages with paint. As a result, passages made of plastics can only be matched to the individual color scheme of a room at an especially high cost.

OBJECTS OF THE INVENTION

In view of the above it is the aim of the invention to achieve the following objects singly or in combination:

- to provide an inductive air passage, that can be produced at least as economically as known air passages and that has the added advantages of a high fire resistance capability and that can be permanently coated with paint of any desired color;
- to construct these passages of a minimum number of sheet metal components;
- to arrange the two sheet metal components relative to each other in such a way that the resulting unit fits into existing ceiling grid structures; and
- to construct these passages so that installed, neighboring passages in a ceiling can influence each other's air flow.

SUMMARY OF THE INVENTION

The inductive air passage of the invention is characterized by two sheet metal plates, one of which forms a frame for at least one inlet opening and the other forms a frame for at least two outlet openings, wherein said one sheet metal plate is provided with an I-shaped slit which forms two lands that are bent to form two curved lips lengthwise bordering the inlet opening. The two curved lips are bent or curved toward an outlet opening. The other sheet metal plate is provided with two U-shaped slits which form two lands that are bent to form tongues lengthwise extending along a respective outlet opening. Each of the two tongues are angled toward a respective edge of the corresponding curved lip forming the inlet opening.

Thus, only two essentially quadrangular or square sheet metal plates are needed in the production of the inductive air passage of the invention. These sheet metal plates are punched-out and shaped to form two structural components that can be arranged relative to each other so that they together form the inductive air passage without any auxiliary means.

In order to maintain a steady air flow along the interface between the inlet opening forming curved lips and the tongues forming the outlet openings, according to a further feature of the invention, side or lengthwise edges of the curved lips that form the inlet opening, abut against a respective side or lengthwise edge of the tongues that form the outlet openings.

According to a further feature of the invention, the two structural sheet metal components forming the inductive air passage can be adequately locked to each other, by a press-fit between at least one element of one sheet metal component and at least one element of the other sheet metal component. For this purpose two lateral wall sections are bent out of the respective sheet metal component at 90° to the plane of the corresponding sheet metal component. The lateral wall sections extend perpendicularly to the length of the curved lips in the first sheet metal component forming the air inlet slot and also perpendicularly to the length of the tongues forming the air outlets in the other sheet metal component. The lateral wall sections have a width in the flow direction sufficient to contact elements of the respective other sheet metal component. Thus, the lateral wall sections can form end walls for the air inlet slot in the first sheet metal component and for the air outlets in the second sheet metal component. The lateral wall sections may both be bent out of the first sheet metal component, or both may be bent out of the second sheet metal component, or one lateral wall section is bent out of one sheet metal component while the other lateral wall section is bent out of the other sheet metal component. In each instance the lateral wall sections provide a connection between both sheet metal components, in that the sides of the lateral wall sections, that face each other, bear against end edges of elements in the respective other sheet metal component. For example, lateral wall sections, bent out of the first sheet metal component, bear against end edges of the tongues forming the air outlets in the other sheet metal component. Lateral wall sections bent out of the second sheet metal component bear against end edges of the curved lips of the first sheet metal component.

A roof-angle-shaped sheet metal strip forming an air baffle or deflector is formed as a separate structural ridge element arranged between the two air outlets. The sheet metal strip overlies or is secured to a sheet metal land between the two outlet openings with the ridge of the ridge element facing toward the air inlet slot, whereby a baffle barrier with a triangular cross-section is formed. Thus, the current paths through the inductive air passage have a diffuser type cross-section, similar to that of known plastic, injection molded inductive air passages.

In a further embodiment of the invention the margins of both sheet metal components are bent at an angle toward the respective other sheet metal component, whereby an essential block-shape is obtained which can be easily integrated, for example, into a cassette-shaped ceiling recess formed by a conventional ceiling grid structure.

A still further feature of the invention uses sheet metal plates having an essentially quadrangular outer contour, whereby neighboring air passages in a row of inductive air passages can be arranged so that the air inlet slots and the air outlet openings of one air passage extend at 90° relative to those of the neighboring air passage. In this manner, the exhaust planes of the air flows of one inductive air passage can cut across the exhaust planes of the air flows of the neighboring air passage, whereby the mixing of the air flows with each other and with the air of the room, is highly effective.

BRIEF DESCRIPTION OF THE DRAWINGS

In order that the invention may be clearly understood, it will now be described, by way of example, with reference to the accompanying drawings, wherein:

FIG. 1 is a vertical cross-section along section line 1—1 of FIG. 2 through an air passage according to the invention having two basic sheet metal components;

FIG. 2 is a plan view in the direction of the arrow A in FIG. 1;

Figure 3:
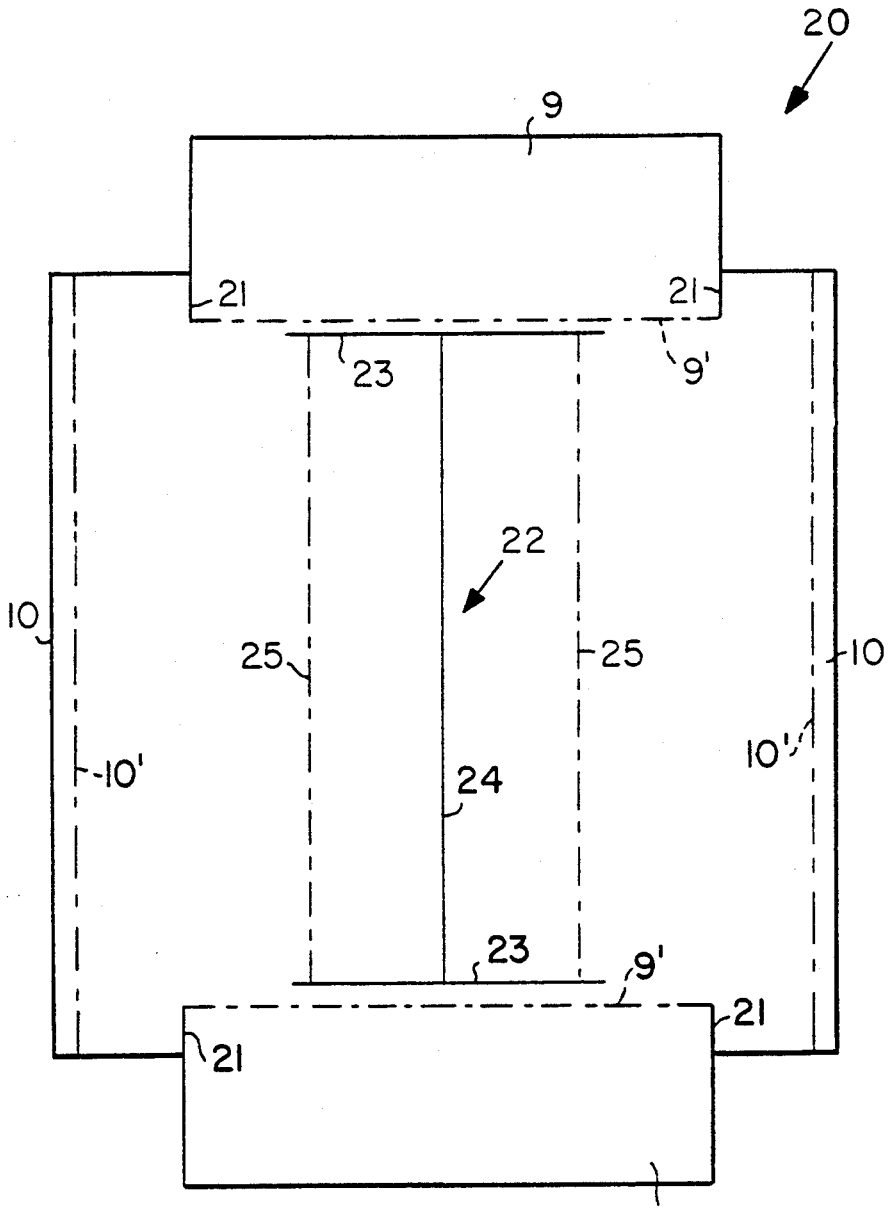
FIG. 3 is a blank with slits cut therein for making one of the two basic sheet metal components.

DETAILED DESCRIPTION OF PREFERRED EXAMPLE EMBODIMENTS AND OF THE BEST MODE OF THE INVENTION

Referring to FIGS. 1 and 2, an inductive air passage of the invention comprises an air inlet slot 1 and two air outlet openings 2, which are connected by a current path 3 having an inverted Y-configuration. Two basic sheet metal components 5 and 6 form the air passage. The air inlet slot 1 is formed in component 5. The air outlet openings 2 are formed in components 6. An air baffle body 4 is formed between the outlet openings 2. For this purpose a sheet metal land 13 is left between the openings 2. Preferably, a roof ridge shaped sheet metal strip 7 having a ridge 7' is secured to the land 13 to form the baffle body 4. The surface area of the baffle body 4 perpendicular to the flow direction A corresponds approximately to the flow cross-sectional area of the air inlet slot 1. The air baffle body is arranged with such a spacing from the plane of the air inlet slot 1, that an effective air distribution or deflection into both outlet openings 2 is assured. Further, the lateral longitudinal edges of the ridge shaped strip 7, preferably coincide approximately with the respective longitudinal edges of the outlet openings 2.

The sheet metal strip 7 will be manufactured separately from the two basic sheet metal components 5 and 6.

The sheet metal component 5 comprises a plate 20 shown as a precut blank in FIG. 3 to be described in more detail below. Component 5 forms a frame for the air inlet slot 1 formed by two curved lips 8 bent out of the plate 20 provided with an I-shaped slit. The two lips 8 are bent in the direction toward the outlet openings 2. The lips 8 each have a lip edge 8'.

Two parallel lateral or outer wall sections 9 are bent out of the sheet metal plate 20. These wall sections 9 run perpendicularly to the length of the air inlet slot 1 and are bent 90° in the direction toward the other sheet metal component 6, thereby forming end walls of the air inlet slot 1, the length of which is bounded by the lips 8. The spacing between the wall sections 9 corresponds to the length of the curved lips 8. The roof-angle-shaped sheet metal strip 7 is arranged between these wall sections 9.

Outer margins 10 of the sheet metal component 5 running parallel to the air inlet slot 1 are bent at a right angle in the direction toward the sheet metal component 6.

The sheet metal component 6 is formed out of a blank 30 shown in FIG. 4 to be discussed in more detail below. The outlet openings 2 are formed by two tongues 11 bent out of the plane of the blank 30. The tongues are arranged mirror symmetrically to one another relative to a vertical central plane extending longitudinally through the air inlet slot 1 and in the air flow direction and lengthwise through the ridge 7'. The tongues 11 are bent in the direction toward the inlet slot 1, so that outer edges 11' of the tongues 8 abut against the outer edges 8' of the lips 11 to thereby create a steady continuous air flow channel 3. The outer margins 12, 12' of the sheet metal blank 30 are angled or bent in the direction of the sheet metal component 5, so that they are aligned with the angled outer margins 10 of the sheet metal component 5.

FIG. 3 shows a plan view of the sheet metal blank 20 for forming the component 5. The margins 10 are bent along dash-dotted lines 10'. The lateral or end walls 9 are bent along dash-dotted lines 9' after slits 21 have first been cut. An I-slit 22 with cross-slits 23 and a longitudinal slit 24 is cut for then bending the lips 8 as best seen in FIG. 1. Such bending takes place approximately along dash-dotted lines 25, whereby the lip edges 8' are formed by the longitudinal slit 24.

Figure 4:
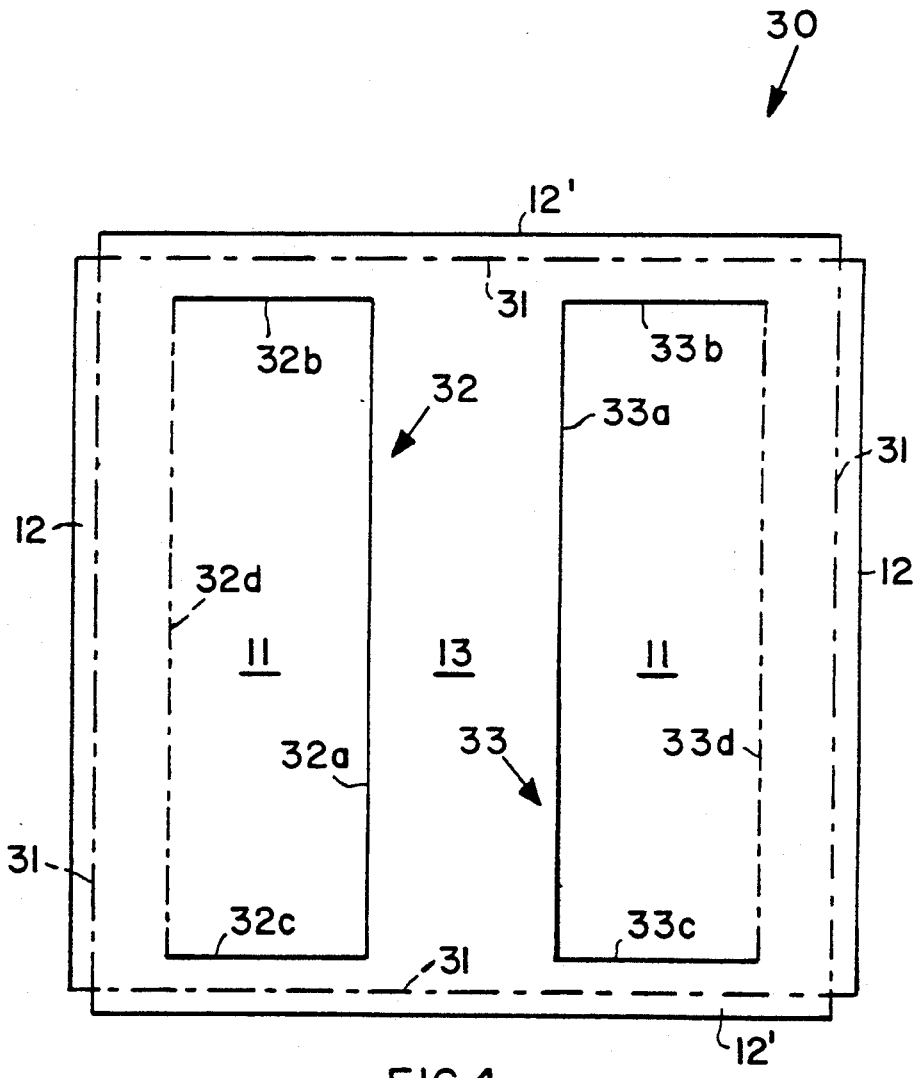
FIG. 4 is a blank also with slits cut therein for making the other basic sheet metal component.

FIG. 4 shows a plan view of the sheet metal blank 30 for forming the component 6. The margins 12 and 12' are bent along dash-dotted lines 31. U-shaped slits 32 and 33 are cut into the blank 30 to form the tongues 11 leaving the land 13 between the tongues 11. For this purpose slit 32 has a longitudinal slit portion **32*a*, an upper slit portion 32*b* and a lower slit portion 32*c*. The tongue 11 is bent approximately along line 32*d*. Similarly, the slit 33 has a longitudinal slit portion 33*a*, an upper slit portion 33*b*, and a lower slit portion 33*c*. The respective tongue 11 is bent along dash-dotted line 33*d***.

With regard to FIG. 3, it should be mentioned that the end walls 9 need not be in blank 20, they could just as well be in blank 30, or one wall 9 could be in one blank while the other wall 9 could be in the other blank. For fitting the two sheet metal components together with a press-fit, it is necessary that the spacing between the walls 9 corresponds to the length of the tongues 11 and preferably also to the length of the lips 8, so that the lips 8 and the tongues 11 are received between the walls 9 with a press-fit between the end edges of the lips 8, and walls 9 and with a press-fit between the end edges of the tongues 11 and the walls 9. If desired, spot weldings 14 may be provided between the end edges of the lips 8 and the walls 9 and between the end edges of the tongues 11 and the walls 9. Any other suitable sheet metal connections may also be used but will normally not be needed because the component 5 can securely rest on the component 6 with the tongues 11 and lips 8 securely held between the walls 9. Holes 9*a* and 9*b* may remain where the walls 9 have been bent out of the blank 20.

The three structural elements of the inductive air passage of the invention can thus be produced economically by a punching-out or die cutting and bending process, and can be economically coated with the desired individual color, for example, by a dipping process. The quadrangular cross-section of the inductive air passage allows a 90° displacement of the length of the outlets of one passage relative to the length of the outlets of a neighboring passage to achieve an efficient air diffusion and intermixing of the incoming air with the air in a room.

Although the invention has been described with reference to specific example embodiments it will be appreciated that it is intended to cover all modifications and equivalents within the scope of the appended claims.

What I claim is:

1. An inductive air passage for introducing air into a space, comprising a first sheet metal component including at least one longitudinal air inlet slot having curved lips bent out of said first sheet metal component, each of said curved lips having a lip edge, a second sheet metal component including at least two elongated air outlets, each of said air outlets having a tongue bent out of said second sheet metal component, each tongue extending at a slant toward the respective lip edge, and air baffle means arranged between said two elongated air outlets at a spacing from a plane defined by said air inlet slot in an air flow direction for deflecting air flowing through said air inlet slot into said air outlets.

2. The inductive air passage of claim 1, wherein said air inlet slot is formed by first cutting an I-slit into said first sheet metal component and then bending lands formed by said I-slit into said curved lips, and wherein said air outlets are formed by first cutting two U-slits into said second sheet metal component and then bending each land formed by said U-slits toward its respective lip edge.

3. The inductive air passage of claim 1, wherein said air baffle means has a width corresponding approximately to a width of said air inlet slot, said widths being measured perpendicularly to the respective length.

4. The inductive air passage of claim 1, wherein each of said lip edges of said air inlet slot abuts against a respective tongue edge of said air outlets.

5. The inductive air passage of claim 1, wherein two lateral wall sections are bent out of the respective sheet metal component at 90° to a plane defined by the respective sheet metal component, said wall sections extending in parallel to each other at a spacing from each other corresponding to a length of said inlet curved lips, said wall sections extending perpendicularly to a length of said inlet curved lips to define end walls of said air inlet slot.

6. The inductive air passage of claim 5, wherein said lateral wall sections have a width between said first and second sheet metal components such that end edges of said air outlet tongues abut against said lateral wall sections.

7. The inductive air passage of claim 6, further comprising connecting means between said lateral wall sections and said air outlet tongues for interconnecting said first and second sheet metal components to each other.

8. The inductive air passage of claim 7, wherein said two lateral wall setions are both bent out of the same sheet metal component.

9. The inductive air passage of claim 7, wherein one of said two lateral wall sections is bent out of one of said lateral sheet metal components while the other lateral wall section is bent out of the other sheet metal component, said lateral wall sections being bent in opposite directions.

10. The inductive air passage of claim 1, wherein said air baffle means comprise a sheet metal land between said two air outlets, said sheet metal land having a width corresponding approximately to a width of said air inlet slot, whereby said curved lips of said air inlet slot are arranged approximately vertically above a respective edge of said sheet metal land.

11. The inductive air passage of claim 10, wherein said air baffle means further comprise a ridge member secured to said sheet metal land, said ridge member having a ridge extending toward said air inlet slot for deflecting inflowing air toward said air outlets in aid second sheet metal component.

12. The inductive air inlet of claim 11, wherein said ridge member has a length substantially corresponding to a length of said air inlet slot.

13. The inductive air inlet of claim 1, wherein each of said first and second sheet metal components have margin strips along sheet metal edges, said margin strips being bent over toward the respective other sheet metal component.

14. The inductive air inlet of claim 1, wherein each of said first and second sheet metal components has a substantially square outer contour.

* * * * *